United States Patent [19]

Okamoto et al.

[11] Patent Number: 4,967,050

[45] **Date of Patent: * Oct. 30, 1990**

[54] HIGH FREQUENCY COOKING DEVICE WITH CEILING MOUNTED SEMI-SPHERICAL REFLECTOR

[75] Inventors: Kenzo Okamoto, Osaka; Fumihiko Kitada, Neyagawa, both of Japan

[73] Assignee: Imanishi Kinzoku Kogyo Kabushiki Kaisha, Osaka, Japan

[ * ] Notice: The portion of the term of this patent subsequent to May 23, 2006 has been disclaimed.

[21] Appl. No.: 403,859

[22] Filed: Sep. 1, 1989

Related U.S. Application Data

[63] Continuation of Ser. No. 124,648, Nov. 24, 1987, abandoned.

[51] Int. Cl.[5] ..... H05B 6/74

[52] U.S. Cl. ..... 219/10.55 F

[58] Field of Search ..... 219/10.55 F, 10.55 A, 219/10.55 E, 10.55 R

[56] References Cited

U.S. PATENT DOCUMENTS

| | | | |
|---|---|---|---|
| 3,210,511 | 10/1965 | Smith | 219/10.55 F |
| 3,641,301 | 2/1972 | Ikeda | 219/10.55 F |
| 3,746,823 | 7/1973 | Whiteley | 219/10.55 F |
| 4,176,266 | 11/1979 | Kaneko et al. | 219/10.55 F |
| 4,642,435 | 2/1987 | Fitzmayer et al. | 219/10.55 F |
| 4,673,783 | 6/1987 | Igarashi et al. | 219/10.55 F |
| 4,833,285 | 5/1989 | Okamoto et al. | 219/10.55 F |

FOREIGN PATENT DOCUMENTS

| | | | |
|---|---|---|---|
| 51569 | 5/1982 | European Pat. Off. | 219/10.55 F |

*Primary Examiner*—Philip H. Leung

[57] ABSTRACT

A high-frequency heat cooking device in which high-frequency electric wave is introduced from a high-frequency oscillating power source into a heating chamber through a power supply opening provided on a ceiling wall of the heating chamber, comprising a semi-spherical reflective device or post being protruded from and integrally formed with a waveguide, on a ceiling face of the waveguide at a position immediately above the power supply opening constructed on the ceiling wall of the heating chamber and the semi-spherical dielectric being located oppositely to the power supply opening.

2 Claims, 2 Drawing Sheets

HIGH FREQUENCY COOKING DEVICE WITH CEILING MOUNTED SEMI-SPHERICAL REFLECTOR

This application is a continuation of application Ser. No. 124,648 filed Nov. 24, 1987, now abandoned.

BACKGROUND OF THE INVENTION

1. Field of the invention

The present invention relates to a high-frequency heat cooking device (electronic range) and more particularly a high-frequency heat cooking device provided with an improved reflective device in the waveguide to give directivity to microwave generated in the high-frequency oscillating power source and transmitting energy into the heating chamber from the power supply opening provided at the ceiling wall of the heating chamber (cooking box).

2. Prior art

In the prior art, there is a publicly known reflective device (also called post or stub) erected at a suitable position in the waveguide of a high-frequency heat cooking device. The reflective devices normally comprises aluminum or copper base materials. However, one disadvantage associated with these materials was high manufacturing cost because of high material cost and greater man-hours of processing and assembling.

The present invention provides a high-frequency heat cooking device equipped with an improved waveguide at a lower cost without using such an expensive material as known in the prior art and by simplifying the construction and assembling process to a great extent.

SUMMARY OF THE INVENTION

An object of the present invention is to provide an improved high-frequency heat cooking device in which high-frequency electric wave generated in a high-frequency oscillating power source is introduced from a power supply opening provided at a ceiling wall of a heating chamber into the heating chamber via a waveguide. Such a high-frequency heat cooking device according to the present invention has a semi-spherical reflective device protruded from and integrally formed with the waveguide, oppositely to said power source opening, on the interior of the ceiling in the waveguide immediately above the power source opening that is equipped on the ceiling wall of said heating chamber.

The protrusion height and diameter of said semi-spherical reflective device should preferably be made one half of a total height of said waveguide.

BRIEF DESCRIPTION OF THE INVENTION

DETAILED DESCRIPTION OF THE PREFERRED EMBODIMENT

Figure 1:
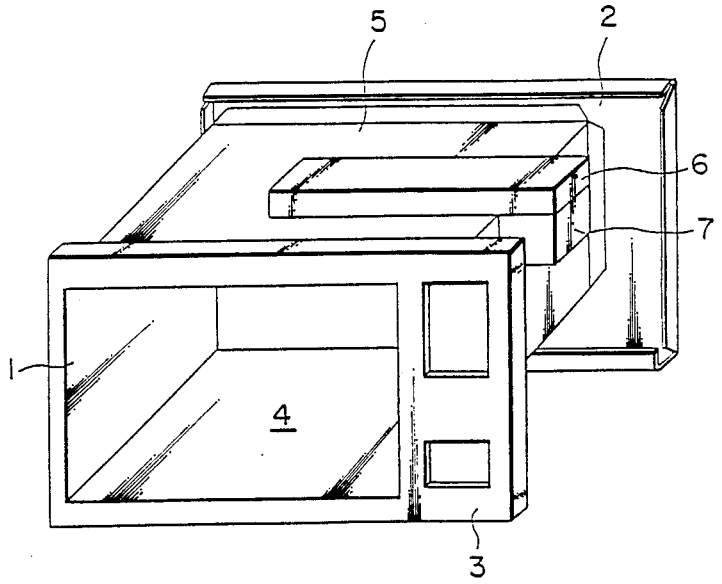
FIG. 1 shows an oblique view of important parts for a high-frequency heating device according to the present invention.

An embodiment of the present invention is detailed in the following paragraphs referring to the drawings.

FIG. 1 is an oblique view for showing important parts after removing the outer cover of a high-frequency heat cooking device equipped with an improved waveguide based on the present invention. A backplate 2 is mounted in the rear part of a main body 1. A front frame 3 is provided in the front side of the main body 1, while said front frame 3 being equipped with an open/close door, although not illustrated in the figure, in a free openable manner using a hinge.

A heat cooking box 4 is constructed in the interior of the main body 1 for housing an object for cooking.

A waveguide 6, comprising a long square box manufactured by pressing a sheet metal, is installed on a ceiling wall 5 of said cooking box 4.

A high-frequency oscillating power source namely magnetron 7 is equipped at the right end of said waveguide 6 in the figure. In addition, a power supply opening 8 is constructed at the left interior of the waveguide 6 on the cooking box namely the ceiling wall of the heating chamber, for introducing the oscillated electric microwave energy into the heating chamber from the magnetron 7.

Figure 2:
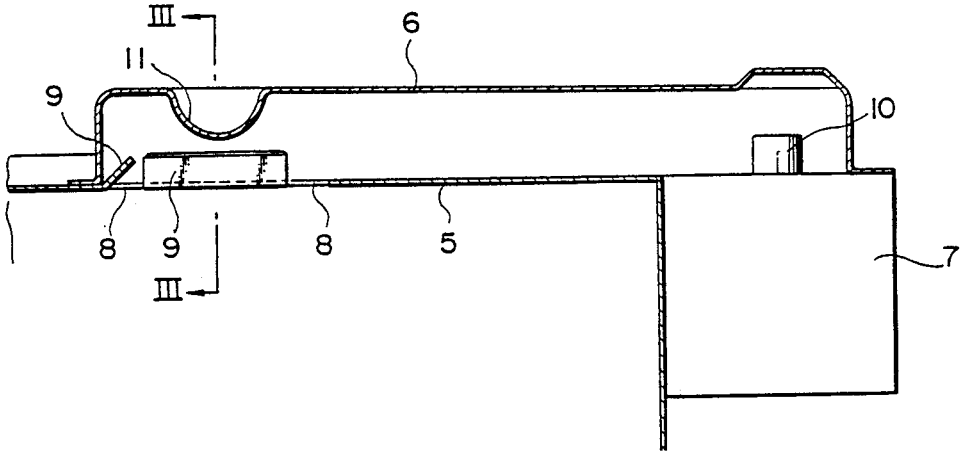
FIG. 2 is a longitudinal section view of the waveguide.
Figure 3:
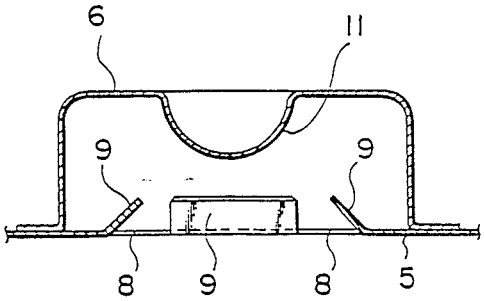
FIG. 3 shows a section along line III—III of FIG. 2.
Figure 4:
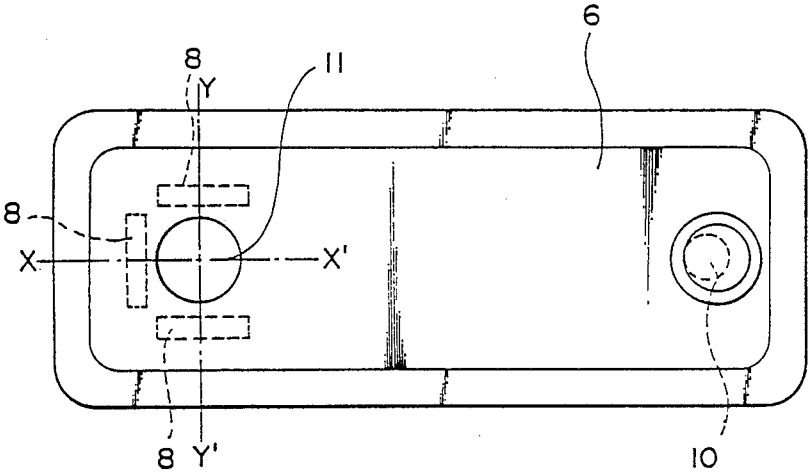
FIG. 4 is an explanatory plan view of the waveguide.

FIG. 2 shows a center longitudinal section view of the waveguide. The upper right end of the waveguide 6 is located at an oscillating antenna 10 of magnetron 7, while its left end being extended to a position where the power supply opening 8 equipped in the ceiling wall 5 of the heat cooking device 4 is covered by the left end. Said power supply opening 8 is distributedly located at three positions shown by chain lines in FIG. 4.

Each part is cut and bent by a press while forming each cut piece towards the waveguide in a suitable angle for constructing each reflective plate 9.

Thus the size of the power source opening 8 becomes suitable to the size of the reflecting plate 9.

According to the present invention, a semi-spherical reflective device 11 is pressed out protrudingly from and integrally formed with the waveguide at a position in the ceiling of the waveguide, said position being opposite just to the center of the power source opening 8 located at three positions, namely at the intersection of lines X—X' and Y—Y'. Accordingly, a protruded part of the reflective device 11 is simultaneously and very easily constructed by pressing a long square box type waveguide through drawing process.

It is preferred that the height of the protruded part is one half of the total height of the waveguide and that the diameter of the protruded part is one half of the width of the waveguide. Thereby, the dielectric can give a directivity to generated electric wave while irradiating microwave energy to an object located in the heating chamber for cooking without leaking the energy to the outside.

According to the present invention as described above, a semi-spherical protruded part namely the reflective device is constructed simultaneously when the waveguide is pressed from sheet metal into a box form. Therefore, raw materials required are greatly reduced while shortening machining process compared to a conventional processing method where members of the dielectric, separately from the component material of the waveguide, are screwed, welded or crimped onto the waveguide. Thus, the present invention provides an advantage of offering a low-cost high-frequency heat cooking device.

What is claimed is:

1. An electronic cooking appliance comprising;

(a) a microwave generator;

(b) a main body defining a cooking chamber arranged to receive objects to be heated;

(c) a waveguide connecting said microwave generator to said cooking chamber;

(d) a plurality of power supply openings formed in a wall common to said waveguide and said cooking chamber; and (e) a reflective device integrally protruding from a top wall of said waveguide and disposed centrally of said plurality of power supply openings, said device having a semi-spherical shape.

2. An electronic appliance as claimed in claim 1, wherein the height of said reflective device is one half of the total height of said waveguide and a diameter of said reflective device adjacent said top wall is one half of the width of said waveguide.

* * * * *